US005141132A

United States Patent [19]

Whelan

[11] Patent Number: 5,141,132

[45] Date of Patent: Aug. 25, 1992

[54] WATER PISTOL

[76] Inventor: Alton R. Whelan, 1973 W. 47th Ave., Vancouver, British Columbia, Canada, V6M 1N5

[21] Appl. No.: 665,999

[22] Filed: Mar. 6, 1991

[51] Int. Cl.[5] ..... A63H 3/18

[52] U.S. Cl. ..... 222/79; 222/210; 141/26; 141/311 R

[58] Field of Search ..... 222/79, 206-213, 222/175, 183, 386.5; 42/1.08, 58; 141/2, 18, 22-26, 311 R; 251/7, 9, 342; 446/475, 473, 94

[56] References Cited

U.S. PATENT DOCUMENTS

| | | | |
|---|---|---|---|
| 688,882 | 12/1901 | Parker | 222/210 X |
| 3,848,808 | 11/1974 | Fetty et al. | 222/183 X |
| 4,114,659 | 9/1978 | Goldberg et al. | 222/212 X |
| 4,214,674 | 7/1980 | Jones et al. | 222/79 |
| 4,257,460 | 3/1981 | Paranay | 222/79 X |
| 4,735,239 | 4/1988 | Salmon et al. | 222/105 X |
| 4,854,480 | 8/1989 | Shindo | 222/79 |
| 4,867,208 | 9/1989 | Fitzgerald et al. | 222/183 X |

FOREIGN PATENT DOCUMENTS

| | | | |
|---|---|---|---|
| 948312 | 7/1949 | France | 222/79 |

*Primary Examiner*—Michael S. Huppert
*Assistant Examiner*—Kenneth DeRosa
*Attorney, Agent, or Firm*—Shlesinger, Arkwright & Garvey

[57] ABSTRACT

A water pistol which includes an elongated, flexible tube removably connectable to the grip of the pistol is disclosed. The tube receives water under pressure directed through the body of the pistol from an inlet port located at the rear or butt end of the pistol. It also serves to force the discharge of water through a front nozzle of the pistol when the user pulls a trigger.

3 Claims, 2 Drawing Sheets

WATER PISTOL

FIELD OF THE INVENTION

This invention relates to toy water pistols.

BACKGROUND TO THE INVENTION

There are a wide variety of known designs for toy water pistols, most of which are characterized by an unpressurized water holding chamber within the hand grip of the pistol. The volume of water that can be held is quite limited, as is the distance that the water will shoot when the trigger is pulled. Typically, the shooting distance is simply a function of the user's ability to apply a sharp force to the trigger.

In U.S. Pat. No. 4,257,640 granted to Paranay et al on Mar. 24, 1981, a water pistol design is disclosed which the loading of water under pressure. In this design, an expandable tube is attached to the butt end of the pistol, and may be filled with water under pressure by water injected backwardly through the nozzle end of the pistol. While this design may certainly achieve greater shooting distances, there are some drawbacks. Firstly, in order to "load" the pistol with water, the nozzle has to be specially configured not only to discharge water, but also to receive water at a reasonable rate. Secondly, the extension of the expandable tube from the butt end of the pistol creates an undesirable weight at that end when the tube is filled with water.

The primary objective of the present invention is to provide a new and improved water pistol which utilizes water under pressure, but which avoids disadvantages like those noted above with respect to the design of Paranay et al.

BRIEF SUMMARY OF THE INVENTION

In accordance with a broad aspect of the present invention, there is provided a water pistol comprising a housing, a water inlet conduit, a water discharge conduit, and an elongated, flexible tube for holding pressurized water. The housing includes an upper body portion and a lower body portion, the upper body portion including a rearward end (viz. butt end) and a forward end (viz. nozzle end). The lower body portion is in the nature of a pistol grip.

The water inlet conduit has a rear inlet port in the rearward end of the housing and extends from the port to a combined inlet-outlet port in the lower body portion. The inlet conduit receives water through the near inlet port from an external source of pressurized water and conducts the water to the combined inlet-outlet port. As well, the housing carries a water discharge conduit that extends from the combined inlet-outlet port to an outlet nozzle in the forward end of the housing. The discharge conduit controllably permits the flow of water from the combined inlet-outlet port to the nozzle.

The flexible tube is removably connectable with the combined inlet-outlet port to receive and hold water introduced through the rear inlet port, and to discharge water from the nozzle via the water discharge conduit.

Advantageously, the rear inlet port includes means for threadingly coupling the rearward end to a water hose which forms part of the external source of pressurized water. This may be a conventional hose coupling, and in any case does not require any adaptation at the nozzle end of the pistol.

It should also be noted that by connecting the flexible tube to the lower body portion of the pistol rather than the butt end of the pistol any weight imbalance is minimized. When filled with water, the tube is relatively heavy, but it pulls downwardly with minimal twisting action in the hands of a user.

BRIEF DESCRIPTION OF THE DRAWINGS

The invention will now be described with reference to the drawings in which.

DETAILED DESCRIPTION

The water pistol shown in the Figures comprises an upper body portion 20 and a lower body portion or grip 40 which merges with the upper body portion and extends downwardly therefrom. As described below in more detail, an elongated, flexible tube 80 is removably connected to the lower end of grip 40.

Figure 3:
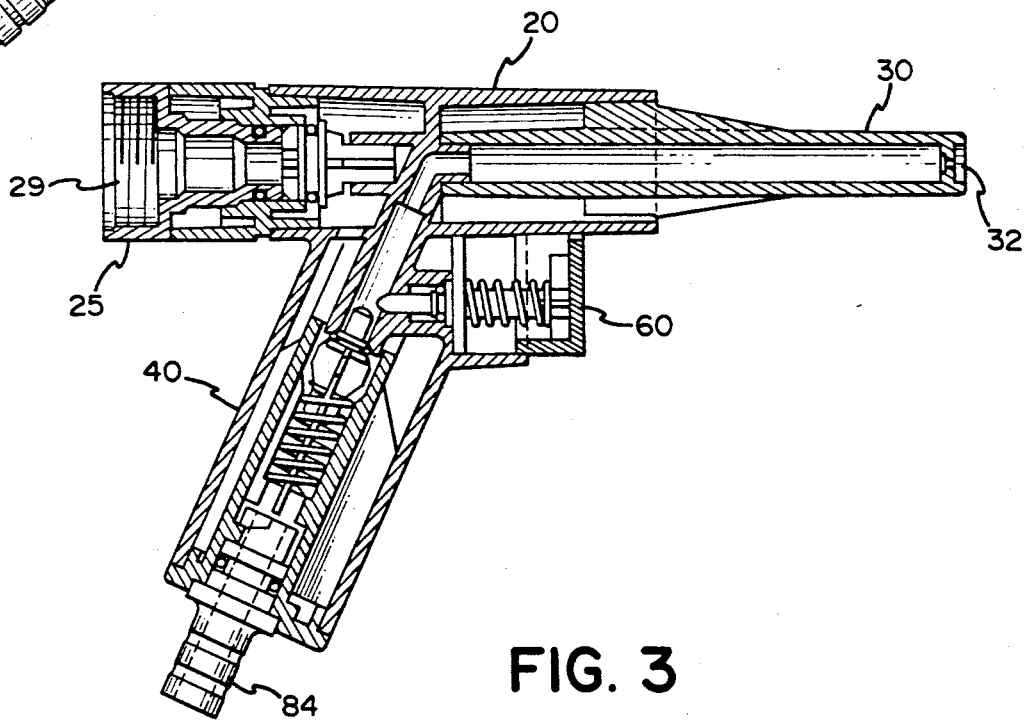
FIG. 3 is a cross-sectional view of the water pistol shown in FIG. 1.
Figure 4:
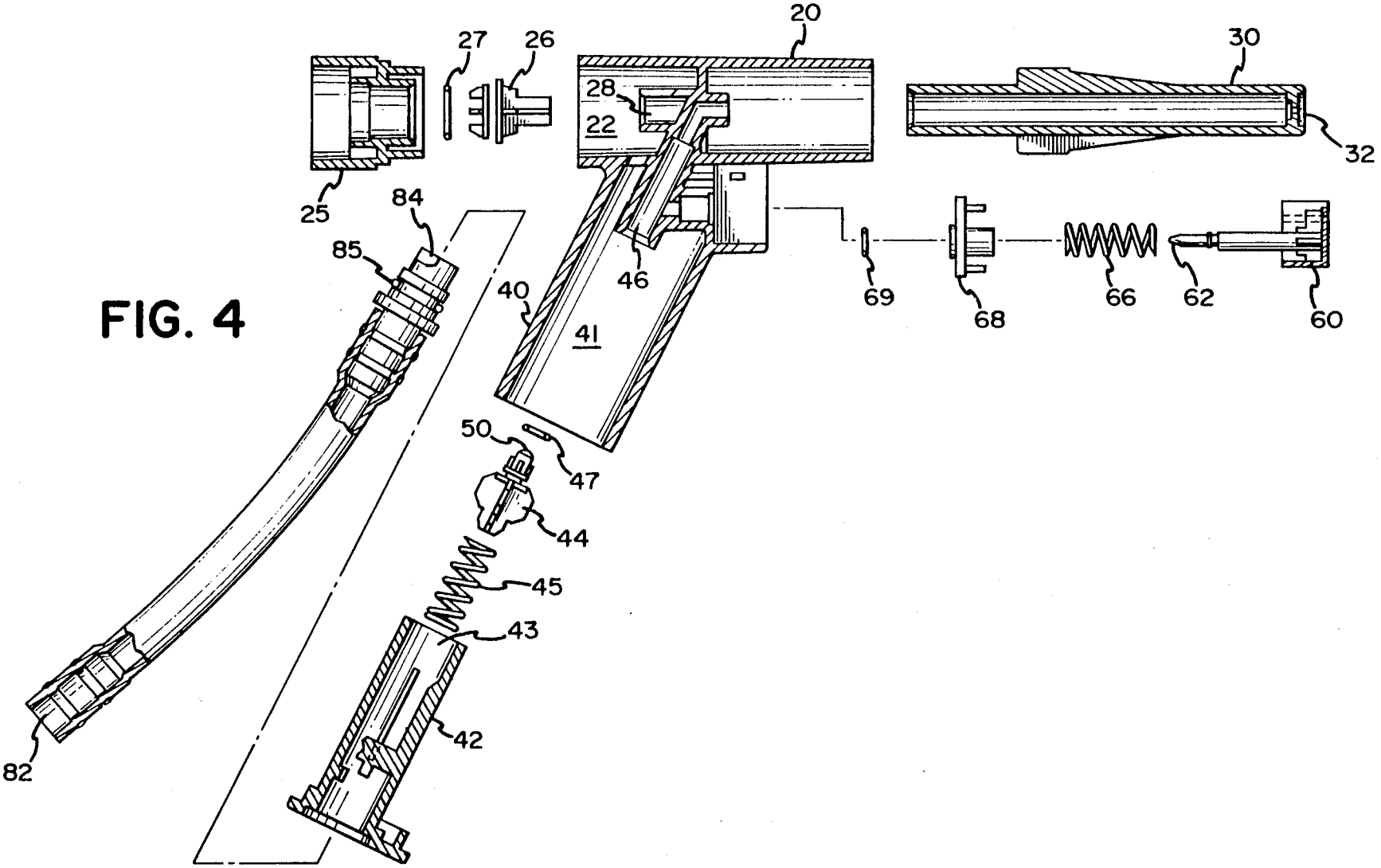
FIG. 4 is a cross-sectional assembly view of the water pistol shown in FIG. 1.

Upper body portion 20 includes a rear inlet port provided by fill port 25, and a barrel 30 that includes a nozzle 32 (the latter of which is best seen in FIGS. 3 and 4).

Figure 1:
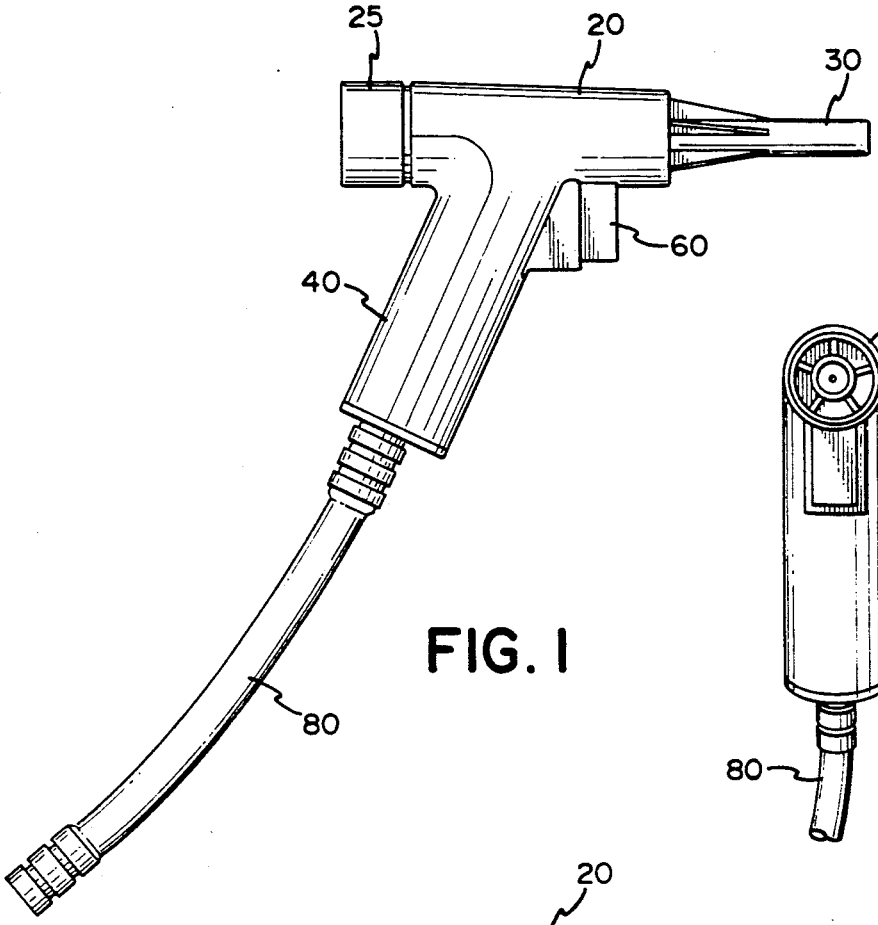
FIG. 1 is a side view of a water pistol in accordance with the present invention.
Figure 2:
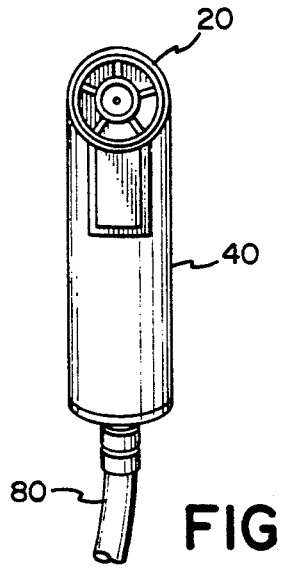
FIG. 2 is a front view of the water pistol shown in FIG. 1.

For the purpose of an overview, it may be noted at this juncture that tube 80 is used to hold water under pressure. When filled, it expands to a size much greater than the unfilled size shown in the Figures. When attached as shown in FIG. 1, tube 80 may be filled with pressurized water injected through fill port 25. Water in tube 80 is subsequently discharged through barrel 30 and nozzle 32 when the user pulls trigger 60.

In more detail, and as best shown in FIG. 4, tube 80 includes a plug 82 at one end, and a twist lock fitting 84 with an O-ring 85 at the opposed end. Twist lock fitting 84 is adapted to connect with discharge valve housing 42 fitted within grip 40 to provide a housing for discharge check valve 44, and discharge valve return spring 45. Normally, check valve 44 is urged upwardly into chamber 46 which is centrally located within the grip - upwardly to the point where O-ring seal 47 seats against the lower rim of chamber 46.

Fill port 25 includes a fill check valve 26 and O-ring 27 that serve to prevent the back flow of water from tube 80 through the fill port. The positioning of check valve 26 is guided by the seat provided within chamber 28 formed in upper body portion 20.

The trigger mechanism for the pistol includes trigger 60, a return spring 66 normally urging trigger 60 to the position shown in FIGS. 1 and 3, a trigger guide 68 that maintains the linear alignment of trigger 60, and an O-ring seal 69 to prevent leakage through the trigger. When trigger 60 is pulled (and this goes against the action of spring 66), tip 62 of the trigger operates against tip 50 of check valve 44 moving check valve 44 downwardly against the action of return spring 45. This opens a water discharge path from the tube 80, through discharge valve housing 42, around check valve 44, through chamber 46 to barrel 30, and ultimately out through nozzle 32. When the trigger is not pulled, this discharge conduit is closed by discharge valve 44. However, water is still permitted to enter under pressure through fill port 25 to tube 80 via chamber 22 in upper body portion 20, chamber 41 in grip 40 and chamber 43 in housing 42.

As best shown in FIG. 3, fill port 25 includes inner threads 29. These threads are preferably sized to permit coupling to a conventional water hose thereby permitting a rapid fill of tube 80.

The main body of the water pistol is best fabricated from plastic. With respect to tube 80, it has been found that rubber surgical tubing works very well. Eventually, the elasticity of such tubing may deteriorate, but it is easily replaceable.

Various modifications to the particular embodiment of the invention that has been described are possible and will undoubtedly occur to those skilled in the art.

I claim:

1. A water pistol, comprising:

(a) a housing having an upper body portion and a lower body portion, said lower body portion merging with an extending downwardly from said upper body portion, said upper body portion including a rearward end and a forward end;

(b) a water inlet conduit carried within said housing, said water inlet conduit having a rear inlet port in said rearward end and extending from said rear inlet port to a combined inlet-outlet port in said lower body portion, said water inlet conduit for receiving water through said rear inlet port from an external source of pressurized water and conducting such water to said combined inlet-outlet port;

(c) a water discharge conduit carried within said housing and extending from said combined inlet-outlet port to an outlet nozzle in said forward end for controllably permitting a flow of water from said combined inlet-outlet port to said outlet nozzle; and, (d) an elongated, flexible tube open at one end and removably connectable at said one end in flow communication with said combined inlet-outlet port:

(i) for receiving and holding pressurized water flowing from said external source of pressurized water through said water inlet conduit from said rear inlet port; and (ii) for discharging said water through said water discharge conduit and from said outlet nozzle.

2. A water pistol as defined in claim 1, including:

(a) a normally closed discharge valve in said water discharge conduit; and, (b) finger controllable triggering means for opening said discharge valve to permit the discharge of water through said water discharge conduit.

3. A water pistol as defined in claim 2, said rear inlet port comprising means for threadingly coupling said rearward end to a water hose forming part of said external source of pressurized water.

* * * * *

UNITED STATES PATENT AND TRADEMARK OFFICE

CERTIFICATE OF CORRECTION

PATENT NO. : 5,141,132

DATED : August 25, 1992

INVENTOR(S) : ALTON RICHARD WHELAN

It is certified that error appears in the above-identified patent and that said Letters Patent is hereby corrected as shown below:

Column 1, line 17, after "which" insert --permits--.

Column 1, line 48, cancel "the" (second occurrence), and substitute --that--.

Column 1, line 48, cancel "near" and substitute --rear--.

Claim 1, line 4, cancel "an" and substitute --and--.

Signed and Sealed this

Twelfth Day of October, 1993

*Attest:*

*Attesting Officer*

BRUCE LEHMAN

*Commissioner of Patents and Trademarks*